US005606302A

United States Patent [19]

Ichida

[11] Patent Number: 5,606,302

[45] Date of Patent: Feb. 25, 1997

[54] PTC CIRCUIT PROTECTION DEVICE WITH NON-OPPOSED SPRING TERMINALS

[75] Inventor: Shigehiro Ichida, Nagaokakyo, Japan

[73] Assignee: Murata Manufacturing Co., Ltd., Japan

[21] Appl. No.: 218,665

[22] Filed: Mar. 28, 1994

[30] Foreign Application Priority Data

Mar. 29, 1993 [JP] Japan ..... 5-014844

[51] Int. Cl.[6] ..... H01C 7/100

[52] U.S. Cl. ..... 338/22 R; 338/203; 338/234; 338/327; 338/324; 338/220; 338/295; 338/225 D

[58] Field of Search ..... 338/22 R, 22 SD, 338/21, 327, 234, 205, 220, 221, 247, 277, 295, 203, 324

[56] References Cited

U.S. PATENT DOCUMENTS

| | | | |
|---|---|---|---|
| 3,914,727 | 10/1975 | Fabricius | 338/22 R |
| 3,978,443 | 8/1976 | Dennis et al. | 338/309 |
| 5,404,126 | 4/1995 | Kasai et al. | 338/21 |

OTHER PUBLICATIONS

Patent Abstracts of Japan, vol. 16, No. 294 (E–1225) 29 Jun. 1992 & JP–A–04 078 103 (Murata Mfg. Co. Ltd.) 12 Mar. 1992, Abstract.

European Search Report dated Jul. 25, 1994.

*Primary Examiner*—Teresa J. Walberg
*Assistant Examiner*—Karl Easthom
*Attorney, Agent, or Firm*—Ostrolenk, Faber, Gerb & Soffen, LLP

[57] ABSTRACT

An electronic component device includes an electronic component element 13 that is interposed between a pair of spring terminals 14 and 15. The electronic component element 13 is resiliently held by the spring terminals 14 and 15, and contact portions 17 and 18 of the spring terminals 14 and 15, which are respectively brought into contact with electrodes **13*b* and 13*c* of the electronic component element 13, are positioned on both major surfaces of the electronic component element 13 so as not to be opposed to each other. At least one groove of a set of grooves 16*a* to 16*c* is formed on at least one of the major surfaces of the electronic component element 13 for guiding the direction in which the electronic component element 13 is divided when the electronic component element 13** is destroyed by, for example, an abnormal voltage.

48 Claims, 4 Drawing Sheets

PTC CIRCUIT PROTECTION DEVICE WITH NON-OPPOSED SPRING TERMINALS

BACKGROUND OF THE INVENTION

1. Field of the Invention

The present invention relates generally to an electronic component device having an electronic component element elastically interposed between a pair of spring terminals, and more particularly, to an electronic component device having a structure that is capable of preventing accidents caused by the destruction of an electronic component element in the case of an abnormality.

2. Description of the Prior Art

FIG. 5 is a cross sectional view showing, as one example of known electronic components, a positive temperature coefficient thermistor (hereinafter referred to as a PTC) device. In a PTC device 1, a PTC element 3 is contained in a case 2 made of synthetic resin. The case 2 comprises a case body 2*a* having an opening formed in its upper part and a cover member 2*b* for closing the opening. The PTC element 3 includes electrodes 3*b* and 3*c* that are formed on both major surfaces of a plate-shaped thermistor body 3*a*.

Elastic portions 4*a* and 5*a* of spring terminals 4 and 5 are brought into contact with the electrodes 3*b* and 3*c*, so that the spring terminals 4 and 5 are electrically connected to the electrodes 3*b* and 3*c*, respectively. The spring terminals 4 and 5 are not only electrically connected to the electrodes 3*b* and 3*c* by the elastic portions 4*a* and 5*a* but also hold the PTC element 3 elastically interposed therebetween to put the PTC element 3 in a predetermined position in the case 2. In this structure, the regions of the elastic portions 4*a* and 5*a*, which are respectively brought into contact with the electrodes 3*b* and 3*c*, that is, the contact portions of the elastic portions 4*b* and 5*b*, are opposed to each other while being separated by the PTC element 3.

In the PTC device 1, however, an abnormal voltage exceeding a rated voltage may, in some cases, be applied to the PTC element 3. Also, the PTC element 3 may, in some cases, be degraded due to, for example, a change in the environment. As a result, the PTC element 3 could be destroyed while it is being used, so that the PTC element pieces 3A and 3B that are formed by the destruction (as shown in FIG. 6) may, in some cases, be scattered in the case 2.

In the conventional PTC device 1, however, the PTC element piece 3A still remains elastically interposed between the spring terminals 4 and 5 even though the PTC element 3 has been destroyed, as shown in FIG. 6. That is, an energized state may still be continued in the PTC element piece 3A after the destruction of the PTC element 3.

SUMMARY OF THE INVENTION

An object of the present invention is to provide an electronic component having a structure formed by elastically interposing an electronic component element between spring terminals such that when the electronic component element is destroyed in the case of an abnormality the element pieces formed are reliably prevented from being energized.

The present invention is directed to an electronic component comprising an electronic component element having electrodes formed on both its major surfaces, and a pair of spring terminals electrically connected to the electrodes of the electronic component element and holding the electronic component element elastically interposed therebetween. The electronic component is characterized in that portions of the spring terminals, which are respectively brought into contact with the electrodes on both sides of the electronic component element, are not opposed to each other at least one groove is provided on at least one of the major surfaces of the electronic component element for guiding the direction in which the electronic component element is destroyed by an abnormality. The groove functions so that the electronic component element is completely cracked into pieces when it is destroyed.

In the present invention, the above described pair of spring terminals are respectively brought into contact with the electrodes of the electronic component element so that the portions of the spring terminals in contact with the electrodes are not opposed to each other. Therefore, when the electronic component element is destroyed at the time of an abnormality pressures applied from the spring terminals to electronic component element pieces formed by the destruction are exerted on different positions on both the major surfaces of the electronic component element, thereby making it difficult to elastically interpose the electronic component element pieces between the pair of spring terminals. As a result, the electronic component element pieces are reliably prevented from being energized.

Furthermore, in case of destruction of the electronic component element, the groove for guiding the direction, in which the electronic component element is cracked, formed on at least one of both the major surfaces of the electronic component element, functions in a manner so that the electronic component element is reliably destroyed along the groove. Consequently, the electronic component element is reliably destroyed at the time of an abnormality, to be divided into a plurality of electronic component element pieces. Accordingly, it is possible to combine the function of the pair of spring terminals and to reliably prevent the electronic component element pieces from being energized.

Therefore, when the electronic component element is destroyed due to, for example, the application of an abnormal voltage or change in the environment the electrically connected state between the plurality of electronic component element pieces formed by the destruction and the spring terminals is reliably ended, thereby making it possible to reliably prevent the electronic component element pieces from being energized after the electronic component element is destroyed.

In accordance with a particular aspect of the present invention, only one of the pair of spring terminals is brought into contact with the electrode in at least one of a plurality of regions separated by the groove on one of the major surfaces of the electronic component element. In this case, in a region where only one of the pair of spring terminals is brought into contact with the electrode, a force from only one spring terminal is applied to the electronic component element in the region if the electronic component element is destroyed along the groove, thereby making it possible to disperse the electronic component element pieces more effectively.

More preferably, in each of the plurality of regions separated by the groove, only one of the pair of spring terminals is brought into contact with the electrode, thereby dispersing the electronic component element pieces obtained by dividing the electronic component element along the groove more effectively.

The foregoing and other objects, features, aspects and advantages of the present invention will become more apparent from the following detailed description of the present invention when taken in conjunction with the accompanying drawings.

A non-restrictive embodiment of the present invention will be described to clarify the present invention.

Figure 2:
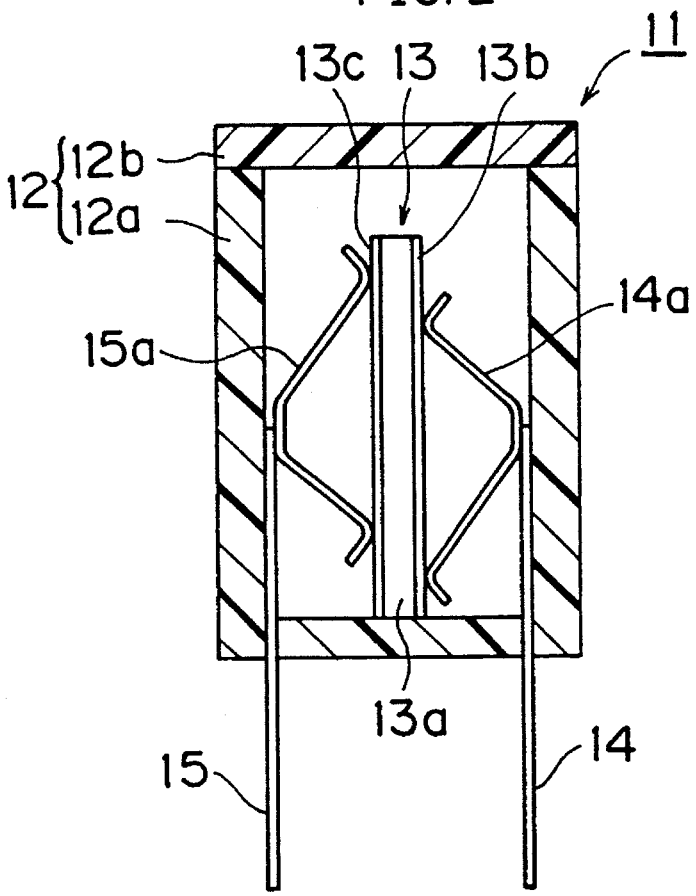
FIG. 2 is a cross sectional view showing a PTC device according to the first embodiment.

FIG. 2 is a cross sectional view showing a PTC device according to one embodiment of the present invention. A PTC device 11 comprises a case 12 made of synthetic resin which is constituted by a case body 12*a* having an opening in its upper part and a cover member 12*b* for closing the opening. A PTC element 13 is contained in the case 12. The PTC element 13 includes electrodes 13*b* and 13*c* that are formed on the entire surface area of major surfaces of a disk-shaped PTC body 13*a*.

The PTC element 13 is elastically interposed between spring terminals 14 and 15 in the case 12. The spring terminals 14 and 15 respectively have elastic portions 14*a* and 15*a* which are brought into elastic contact with the electrodes 13*b* and 13*c* in the case 12. The relationship between the elastic portions 14*a* and 15*a* and the PTC element 13 will be described with reference to FIGS. 1A and 1B.

Figure 1A:
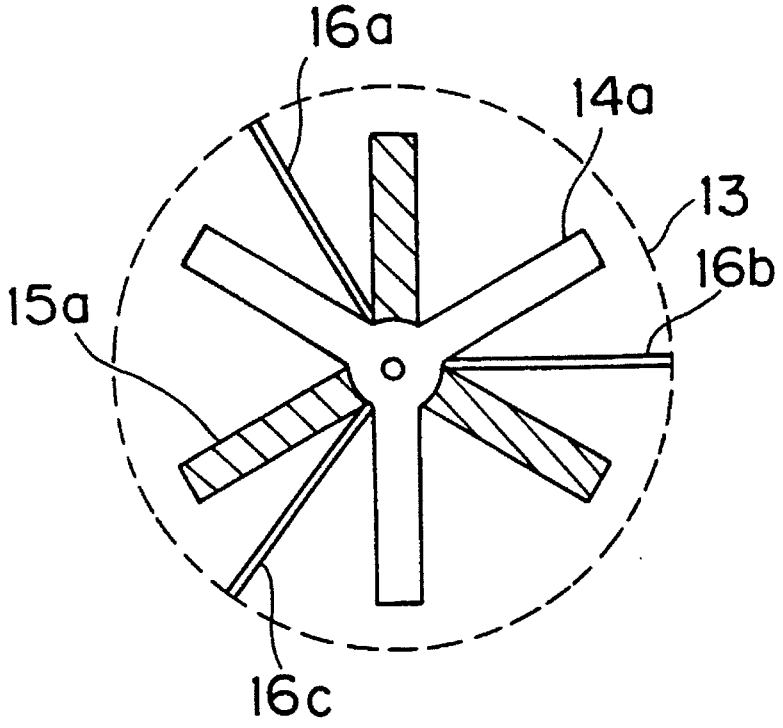
FIGS. 1A and 1B are respectively a schematic front view and a side view showing the relationship between elastic portions of spring terminals and a PTC element in a first embodiment of the present invention.

FIG. 1A is a diagram as viewed from the elastic portion 14*a* of the spring terminal 14, where the position of the elastic portion 15*a* of the other spring terminal 15 formed on the major surface on the opposite side of the PTC element 13 is illustrated by oblique hatching.

Figure 1B:
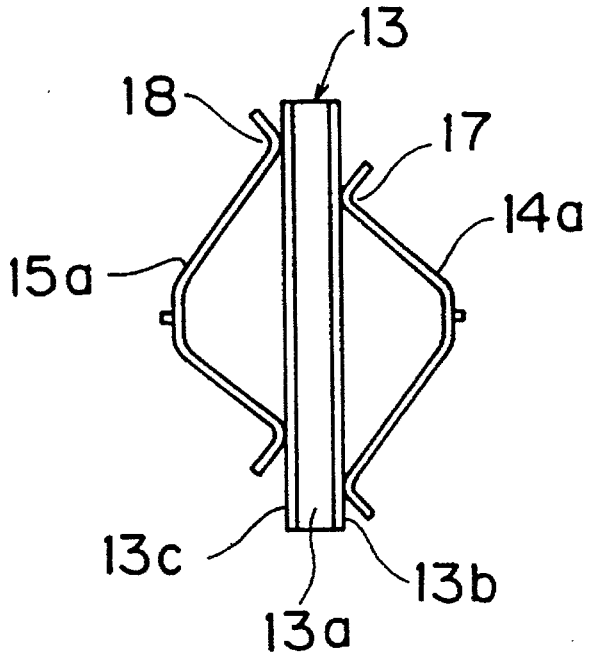

As apparent from FIGS. 1A and 1B, the elastic portions 14*a* and 15*a* of the spring terminals 14 and 15 respectively have branched portions extending in a radial manner in three directions from the center of the PTC element 13, and contact portions 17 and 18 which are brought into direct contact with the electrodes 13*b* and 13*c* are formed in the vicinities of ends of the branched portions. In the present embodiment, the branched portions are not opposed to each other on both the major surfaces of the PTC element 13, so that the contact portions 17 and 18 are not opposed to each other on both the major surfaces of the PTC element 13.

Although in FIG. 1A, the elastic portions 14*a* and 15*a* are respectively in a shape having branched portions extending in a radial manner in three directions from the center of the PTC element, the elastic portions 14*a* and 15*a* may be constructed in another shape so long as the contact portions 17 and 18 of the elastic portions 14*a* and 15*a* are in positions where they are not opposed to each other while being separated by the PTC element 13 and the PTC element 13 can be elastically interposed between the spring terminals 14 and 15 in the case 12.

Furthermore, three grooves 16*a* to 16*c* are formed on both the major surfaces of the PTC element 13 so as to extend toward the outer periphery from the center of the major surface of the PTC element 13, as shown in FIG. 1A. The grooves 16*a* to 16*c* on one of the major surfaces are formed so as to be opposed to the grooves on the other major surface. The grooves 16*a* to 16*c* are provided so as to ensure that the PTC element 13 is divided into pieces along the grooves 16*a* to 16*c* when it is destroyed at the time of an abnormality.

In the present embodiment, the grooves 16*a* to 16*c* are formed so as to divide the major surface of the PTC element 13 into three equal divisions. If the grooves formed on the major surface of the PTC element are formed so as to divide the PTC element 13 into equal divisions, no extraordinarily large PTC element pieces remain in the case of the destruction, thereby making it possible to more reliably prevent the PTC element pieces from being energized.

Figure 3A:
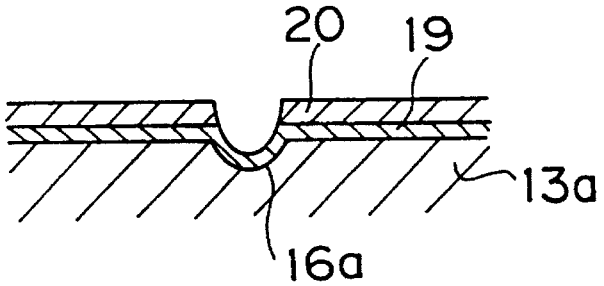
FIGS. 3A and 3B are respectively partially cutaway enlarged sectional views showing the relationship between a groove and an electrode.
Figure 3B:
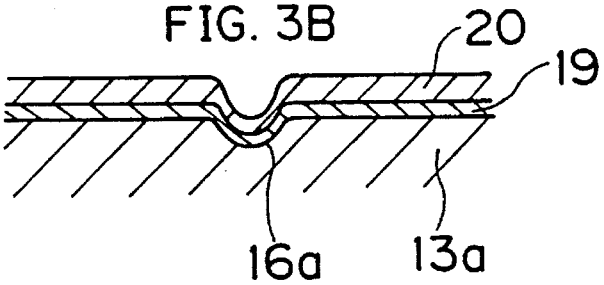

The above described grooves 16*a* to 16*c* are formed by machining both the major surfaces of the PTC element 13, and the electrodes 13*b* and 13*c* are formed so as to also cover inner peripheral surfaces of the grooves 16. If in the PTC element 13, each of the electrodes 13*b* and 13*c* is formed by laminating a first electrode layer made of Ni and a second electrode layer made of Ag, either one of the electrodes 13*b* and 13*c* may be formed so as to cover the inner peripheral surfaces of the grooves 16. For example, as shown in FIG. 3A, each of the electrodes 13*b* and 13*c* may be formed so that only the first electrode layer 19 made of Ni on the lower side extends to the groove 16*a* formed in the PTC body 13*a* and the second electrode layer 20 made of Ag does not extend to a portion where the groove 16*a* is formed. Alternatively, as shown in FIG. 3B, each of the electrodes 13*b* and 13*c* may be formed by laminating both the first and second electrode layers 19 and 20 so as to extend to the groove 16*a* formed in the PTC body 13*a*.

In the PTC device 11 according to the present embodiment, even if the PTC element 13 is destroyed by, for example, the application of an abnormal voltage, the PTC element pieces slip downward between the spring terminals 14 and 15 because the contact portions 17 and 18 of the spring terminals 14 and 15 are not opposed to each other, thereby making it impossible to elastically interpose the PTC element pieces between the spring terminals 14 and 15.

Moreover, the PTC element 13 is destroyed along the above described grooves 16*a* to 16*c*, so that no overly large PTC element pieces are easily formed. Accordingly, the PTC element pieces can be scattered in the case 12, thereby making it possible to end the electrically connected state with the spring terminals 14 and 15.

Figure 4A:
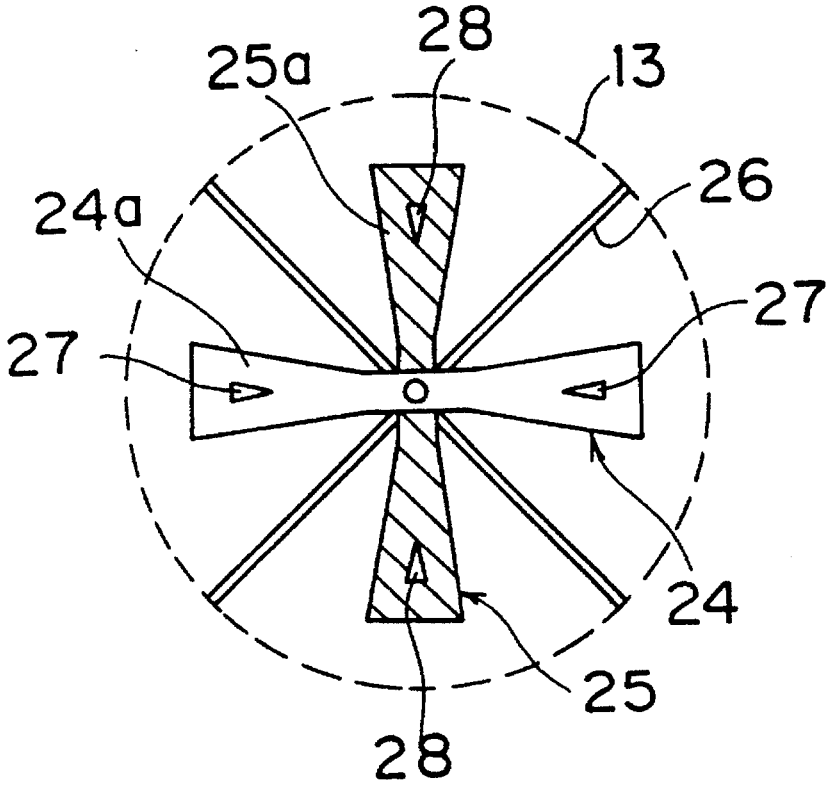
FIGS. 4A and 4B are respectively a schematic front view and a side view showing the relationship between spring terminals and a PTC element in a PTC device according to a second embodiment.
Figure 4B:
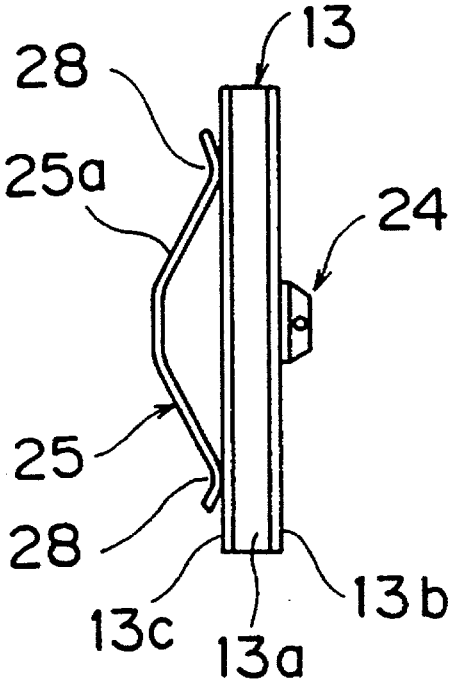
Figure 5:
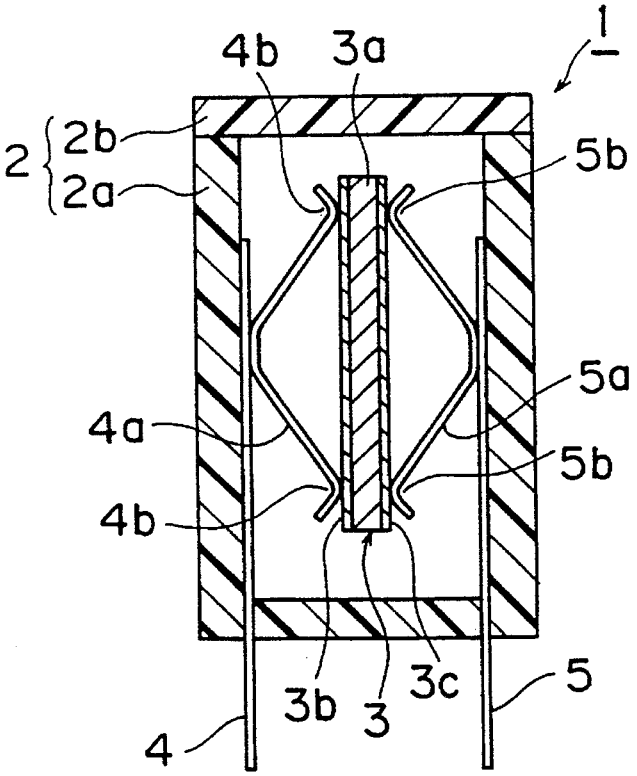
FIG. 5 PRIOR ART
FIG. 5 is a cross sectional view showing a conventional PTC device.
Figure 6:
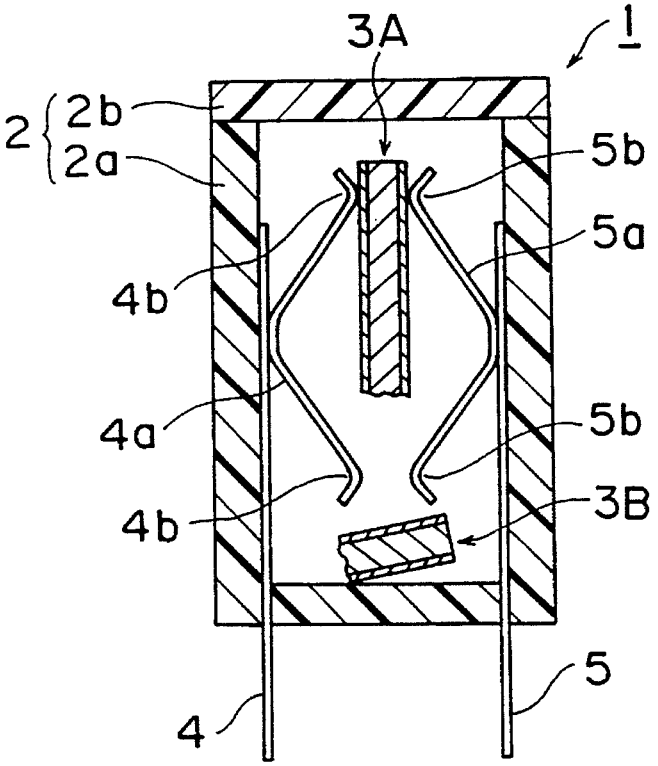
FIG. 6 PRIOR ART
FIG. 6 is a cross sectional view showing the the conventional PTC device with a PTC element that has been destroyed.

FIGS. 4A and 4B show the relationship between the electrodes and a PTC element in a PTC device according to another embodiment of the present invention, where FIGS. 4A and 4B respectively correspond to FIGS. 1A and 1B showing the first embodiment.

The second embodiment is constructed similarly to the first embodiment except that the shape of the spring terminals and the shape of the grooves are altered. A description is made of only the shape of the spring terminals and the grooves formed in the PTC element.

In the present embodiment, cross-shaped grooves orthogonal to each other are formed, (as shown in FIG. 4A), on both major surfaces of a disk-shaped PTC element 13. Although in FIG. 4A, only grooves 26 on one of the major surfaces are illustrated, grooves of the same shape are also formed in positions opposed to the grooves 26 on the other major surface. Since in the PTC element 13, the direction in which the PTC element 13 is divided in the case of destruction is guided by the grooves 26, therefore, the PTC element 13 can be divided into four PTC element pieces in the shape of a fan whose central angle is approximately 90°.

On the other hand, the PTC element 13 is constructed so that an elastic portion 24*a* of a spring terminal 24 extend upward and downward, as shown in FIG. 4A, and an elastic portion 25*a* of the other spring terminal 25 extend in the transverse direction of the drawing. Consequently, the elastic portions 24*a* and 25*a* respectively have contact portions 27 and 28 at both their ends. However, each of the contact portions 27 and 28 is brought into contact with the electrode in only one of regions separated by the grooves 26, and only one of the contact portions 27 and 28 is brought into contact with the electrode in any one of regions separated by the grooves 26. In the PTC device according to the second embodiment, therefore, if the PTC element 13 is destroyed along the grooves 26, the contact portions 27 and 28 of the elastic portions 24*a* and 25*a* respectively apply their pressures only to different PTC element pieces. Accordingly, each of the PTC element pieces cannot be interposed between the spring terminals 24 and 25.

If the arrangement of the grooves 26 and portions with which the contact portions 27 and 28 of the spring terminals 24 and 25 are brought into contact are selected so that only one of the contact portions 27 and 28 abuts against the electrode in each of the regions separated by the grooves 26 formed on both the major surfaces of the PTC element 13, it is possible to more reliably prevent the PTC element pieces from being energized.

Although in the first and second embodiments, the grooves 16*a* to 16*c* and 26 are formed on both major surfaces of the PTC element 13 so as to be opposed to each other, the above described grooves may be formed on only one of the major surfaces. Further, even when the grooves are formed on both the major surfaces, the grooves need not be formed so as to be opposed to each other between the major surfaces as described above.

Furthermore, the shape of the grooves is not limited to a shape extending outward from the center of the PTC element as shown. Grooves in an arbitrary planar shape can be formed on at least one of the major surfaces of the PTC element so long as the division of the PTC element can be guided so that the PTC element pieces cannot be interposed between the spring terminals.

Additionally, although in the above described embodiments, description was made of only the PTC element, the present invention is not limited to the PTC element. For example, the present invention is similarly applicable to an electronic component constructed with another electronic component element such as a negative temperature coefficient thermistor element.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electronic component device, comprising:

an electronic component element having first and second opposed conductive surfaces, at least one groove being formed on said first surface and dividing said first surface into a plurality of separate areas; and first and second spring terminals in contact with said first and second surfaces, respectively, said first and second spring terminals serving by themselves to elastically support said electronic component element between said spring terminals; said first spring terminal having at least two contact sections each of which are in contact with a respective one of said plurality of separate areas of said first surface, said second spring terminal having at least one contact section which is in contact with said second surface, said contact sections of said first spring terminal not being opposed to said at least one contact section of said second spring terminal such that if said electronic component element breaks along said at least one groove, said electronic component element is not supported by said spring terminals and any electrical connection between said first and second spring terminals via said electronic component element is eliminated.

2. The device of claim 1, wherein said at least one groove comprises a groove that divides said electronic component element into first and second sections and said first spring terminal has first and second contact sections which are in contact with said first and second sections of said electronic component element, respectively.

3. The device of claim 2, wherein said second spring terminal also has first and second contact sections which are in contact with said first and second sections of said electronic component element, respectively.

4. The device of claim 3, wherein said electronic component element is circular in shape and said groove extends in a radial direction of said electronic component element.

5. The device of claim 3, wherein said at least one groove further comprises a second groove formed in said second surface at a position opposed to said first groove.

6. The device of claim 1, wherein said electronic component device is a positive coefficient thermistor.

7. The device of claim 1, wherein said at least one groove comprises first and second grooves which cooperate to divide said electronic component element into first through fourth sections and said contact sections of said first spring terminal are in contact with said first and second sections of said electronic component element, respectively.

8. The device of claim 7, wherein said contact sections of said second spring terminal are in contact with said third and fourth sections of said electronic component element, respectively.

9. The device of claim 8, wherein said first and second spring terminals each have only two contact sections in contact with said electronic component element.

10. The device of claim 9, wherein said first and second grooves are formed on one of said surfaces.

11. The device of claim 10, further including third and fourth grooves formed on the other one of said surfaces at positions opposite said first and second grooves, respectively.

12. The device of claim 9, wherein said first groove is formed on said first surface and said second groove is formed on said second surface.

13. The device of claim 7, wherein said electronic component element is a positive temperature coefficient thermistor.

14. The device of claim 1, wherein said at least one groove comprises first, second and third grooves which cooperate to divide said electronic component element into first, second and third sections and said first spring terminal has at least three contact sections, each of said first through third sections of said electronic component element being in contact with at least one contact section of said first spring terminal.

15. The device of claim 14, wherein said second spring terminal has at least three contact sections, each of said first through third sections of said electronic component element being in contact with at least one contact section of said second spring terminal.

16. The device of claim 14, wherein said first, second and third grooves are formed in one of said surfaces.

17. The device of claim 16, wherein said electronic component element is circular in shape and wherein said grooves extend radially from a center of said electronic component element.

18. The device of claim 17, wherein said grooves divide said electronic component element into three substantially equal sections.

19. The device of claim 14, wherein said electronic component element is circular in shape and wherein said grooves extend radially from a center of said electronic component element.

20. The device of claim 19, wherein said grooves divide said electronic component element into three substantially equal sections.

21. The device of claim 16, wherein said at least one groove further comprises fourth, fifth and sixth grooves formed in the other of said surfaces opposite said first, second and third grooves, respectively.

22. The device of claim 14, wherein said electronic component element is a positive temperature coefficient thermistor.

23. The device of claim 1, wherein said at least one groove comprises first, second and third grooves which cooperate to divide said electronic component element into first, second and third sections and said first spring terminal has only three contact sections, each of said contact sections being in contact with a respective one of said first through third sections of said electronic component element.

24. The device of claim 23, wherein said second spring terminal has only three contact sections, each of said contact sections being in contact with a respective one of said first through third sections of said electronic component element.

25. The device of claim 24, wherein said first, second and third grooves are formed in one of said surfaces.

26. The device of claim 24, wherein said electronic component element is circular in shape and wherein said grooves extend radially from a center of said electronic component element.

27. The device of claim 26, wherein said grooves divide said electronic component element into three substantially equal sections.

28. An electronic component device, comprising:

an electronic component element having first and second opposed conductive surfaces, at least one frangible element formed in said electronic component element for defining first and second areas of said electronic component element, said frangible element causing said electronic component element to split into separate pieces corresponding to said first and second areas in the event that said electronic component element is broken due to an abnormality;

a first spring terminal in contact with said first surface and having at least two contact sections, at least one of which contacts said first surface in said first area and at least one of which contacts said first surface in said second area;

a second spring terminal in contact with said second surface and having at least one contact section which contacts said second surface;

said first and second spring terminals contacting said first and second surfaces in such a manner that said electronic component element is elastically supported between said first and second spring terminals and there is an electrical connection between said first and second spring terminals via said electronic component element;

said contact sections of said spring terminals causing said electronic component element to be displaced in the event that said electronic component element is broken along said frangible element in such a manner that said electrical contact between said first and second spring terminals via said electronic component element is eliminated.

29. The device of claim 28, wherein said second spring terminal also has at least two contact sections, at least one of which contacts said second surface in said second area and at least one of which contacts said second surface in said second area.

30. The device of claim 29, wherein said electronic component element is circular in shape and each of said at least one frangible element extends in a radial direction of said electronic component element.

31. The device of claim 29, wherein said at least one frangible element comprises a first groove formed in said first surface and a second groove formed in said second surface at a position opposed to said first groove.

32. The device of claim 28, wherein said electronic component device is a positive coefficient thermistor.

33. The device of claim 28, further including at least one additional frangible element cooperating with said at least one frangible element for dividing said electronic component element into four discrete areas, said contact sections of said first spring terminal being in contact with said two of said discrete areas of said electronic component element, respectively, said second spring terminal having first and second contact sections which are in contact with the remaining two of said discrete areas of said electronic component element, respectively.

34. The device of claim 33, wherein said first and second spring terminals each have only two contact sections in contact with said electronic component element.

35. The device of claim 34, wherein said at least one frangible element is a single groove formed on said first surface and said at least one additional frangible element is a single groove formed on said first surface.

36. The device of claim 34, wherein said at least one frangible element comprises first and second grooves formed said first and second surfaces, respectively, at positions opposed to one another and said at least one additional frangible element comprises third and fourth grooves formed on said first and second surfaces, respectively at positions opposed to one another.

37. The device of claim 33, wherein said electronic component element is a positive temperature coefficient thermistor.

38. The device of claim 28, further comprising at least one additional frangible element cooperates with said at least one frangible element to divide said electronic component element into first, second and third areas, said first spring terminal having at least three contact sections, each of said first through third areas of said electronic component element being in contact with at least one contact section of said first spring terminal.

39. The device of claim 38, wherein said second spring terminal has at least three contact sections, each of said first through third areas of said electronic component element being in contact with at least one contact section of said second spring terminal.

40. The device of claim 38, wherein said electronic component element is circular in shape and wherein said frangible elements extend radially from a center of said electronic component element.

41. The device of claim 40, wherein said frangible elements divide said electronic component element into three substantially equal areas.

42. The device of claim 38, wherein said electronic component element is a positive temperature coefficient thermistor.

43. The device of claim 28, further comprising at least one additional frangible element which cooperates with said at least one frangible element to divide said electronic component element into first, second and third areas, said first spring terminal having only three contact sections, each of said contact sections being in contact with a respective one of said first, second and third areas of said electronic component element.

44. The device of claim 43, wherein said second spring terminal has only three contact sections, each of said contact sections being in contact with a respective one of said first, second and third areas of said electronic component element.

45. The device of claim 44, wherein said frangible elements are formed in one of said surfaces.

46. The device of claim 43, wherein said electronic component element is circular in shape and wherein said frangible elements extend radially from a center of said electronic component element.

47. The device of claim 46, wherein said frangible elements divide said electronic component element into three substantially equal sections.

48. The device of claim 28, wherein said device further comprises a housing encasing both said electronic component element and said first and second spring terminals and wherein said housing does not touch said first and second surfaces of said electronic component.

* * * * *